US005538139A

United States Patent [19]

Keller

[11] Patent Number: 5,538,139

[45] Date of Patent: Jul. 23, 1996

[54] ARRANGEMENT FOR A PLANSIFTER

[75] Inventor: Alois Keller, Uzwil, Switzerland

[73] Assignee: Buehler AG, Switzerland

[21] Appl. No.: 90,112

[22] PCT Filed: Feb. 24, 1993

[86] PCT No.: PCT/CH93/00046

§ 371 Date: Jul. 20, 1993

§ 102(e) Date: Jul. 20, 1993

[87] PCT Pub. No.: WO93/16815

PCT Pub. Date: Sep. 2, 1993

[30] Foreign Application Priority Data

Feb. 29, 1992 [CH] Switzerland ..... 00631/92

[51] Int. Cl.[6] ..... B07B 1/54

[52] U.S. Cl. ..... 209/382; 209/385; 209/405; 209/408; 209/331; 209/357; 209/353; 209/352

[58] Field of Search ..... 209/387, 385, 209/382, 381, 341, 333, 332, 331, 357, 355, 353, 352, 405, 408

[56] References Cited

U.S. PATENT DOCUMENTS

| | | | |
|---|---|---|---|
| 218,530 | 8/1879 | Holcomb et al. | 209/382 |
| 229,121 | 6/1880 | Hamper | 209/382 |
| 687,743 | 12/1901 | Green | 209/332 X |
| 699,026 | 4/1902 | Shaler | 209/387 |
| 705,027 | 7/1902 | Brantingham | 209/382 |
| 2,001,631 | 5/1935 | Rice | 209/382 |
| 2,086,199 | 7/1937 | Williams . | |
| 2,304,325 | 12/1942 | Williams et al. | 209/382 X |
| 2,455,383 | 12/1948 | Pickard | 209/382 X |
| 2,864,500 | 12/1958 | Miller | 209/403 |
| 3,422,955 | 1/1969 | Mock et al. . | |
| 3,565,251 | 2/1971 | Pennington . | |
| 4,288,320 | 9/1981 | Wilson . | |
| 5,051,171 | 9/1991 | Hukki . | |

FOREIGN PATENT DOCUMENTS

| | | |
|---|---|---|
| 330846 | 9/1989 | European Pat. Off. . |
| 1282737 | 12/1961 | France . |
| 601481 | 8/1934 | Germany . |
| 875133 | 4/1953 | Germany . |
| 1901932 | 3/1964 | Germany . |
| 1932092 | 2/1966 | Germany . |
| 7936430 | 7/1980 | Germany . |
| 86 31 814.4 | 2/1987 | Germany . |
| 379890 | 9/1964 | Switzerland . |
| 450125 | 4/1968 | Switzerland . |
| 162021 | 4/1964 | U.S.S.R. . |
| 1125068A | 11/1984 | U.S.S.R. . |
| 927469 | 5/1963 | United Kingdom . |
| 1134640 | 11/1968 | United Kingdom . |

OTHER PUBLICATIONS

Excerpt, KOLOS, Moscow, 1971, pp. 14–29.

"Die Siebreinigung im Plansichter", pp. 9–23, Detmold, 1976.

*Primary Examiner*—David H. Bollinger

*Attorney, Agent, or Firm*—Finnegan, Henderson, Farabow, Garrett & Dunner

[57] ABSTRACT

A large or square plansifter has a large number of sieve stacks with e.g. more than 20 sieve boxes. Such boxes are constructed without a supporting grating and design so as to be exchangeable in the covered state and so that they can be placed on or in the sieve frames. A free product fall-through space or discharge space is accordingly formed between the sieve screen and a flat base plate. The sieve cleaners are placed on or in the flat base plate. In a particularly preferred manner, the sieve frames are constructed as metal frames. The sieve cleaners clean the sieve screen and clear the product from the base plate. The sieve cleaners preferably have 2, 3 or 4 arms.

21 Claims, 6 Drawing Sheets

ARRANGEMENT FOR A PLANSIFTER

BACKGROUND OF THE INVENTION a) Technical Field

The invention relates to an arrangement for plansifters including a plansifter sieve having a sieve box with base plate and fine-product discharge, an insert sieve frame and freely movable cleaning members.

A plansifter, particularly the large plansifter or square plansifter, is a large cube with large surface elements and is a special separating device typically employed in mill processing technique for sifting break, semolina, and flour products and for sorting different types of grain such as wheat, rye, corn, barley, etc.

b) Background Art

It is known in many separating techniques, e.g. in chemical processing technology, to reduce the product humidity, if necessary, so that the separating devices do not become clogged. In contrast, optimal grinding humidity must be achieved for processing ground grain products to form flours, semolina, middlings, etc. But since grinding and sifting must be performed repeatedly in a grain mill, the humidity is regulated according to the grinding and not to the best possible sifting results.

It is known that many grinding fractions have poor flow properties or sifting properties due to the high humidity as can also be experienced in the home kitchen when sifting flour.

In a plansifter, all possible sizes of sieve mesh are used—from the finest, e.g. 80 microns, to the coarsest. It is equally important in every case to achieve the maximum sieve output without clogging the sieve mesh. It must be possible to achieve maximum throughput with the highest possible quality of ground products. In mill sifting, as opposed to classical sieving techniques, a closed product layer amounting to several centimeters is maintained over the sieve covering. In this way, a greater downward pressure (force of gravity) against the sieve covering acts on the finer, heavier portions, resulting in a higher throughput and greater sieving rate. On the other hand, flatter husk parts should float to the top as coarse product with the layer as sieve tailings. This type of "thick-layer sifting" causes severe problems in the case of moist grinding products and has a strong tendency to clog the sieve screen.

Systematically over the last 100 years, higher-capacity plansifters have been developed and sieve cleaning has been steadily improved. Innumerable variations of shapes and materials have been tested and sometimes incorporated in practice. In large plansifters, few shapes have been retained. Interestingly, textile belt pieces of 5–10 centimeters in length with a metal knob in the center have been most widely used for cleaning the sieve screen. The sieve screen cleaners are inserted and locked in individually between the woven sieve covering and a supporting grate. For this reason, the underside of the sieve frame is covered with a metal grid as support for the sieve screen cleaners. The metal grid usually exhibits a slight waviness so that the metal knob is struck sharply by the metal grid. The belt piece moves about intensively in a jerky, noisy manner as a result of the oscillating or circular motion of the entire plansifter. In this way the mesh openings are kept free and clean by the fringed ends of the belt pieces. The metal grid and the metal knob serve an important function for the movement of the sieve screen cleaner. A disadvantage consists in that the movement also causes a very audible noise. Sieve cleaning pieces of plastic in various forms which work in the same manner are also known.

Another problem area in plansifters consists in keeping the base plate completely clear. The fine product (throughs) falling through the sieve mesh should be cleared off the base plate within the shortest possible period of time and removed through lateral slots. A separate category of cleaning members, so-called base cleaners, have also been developed for this purpose which conventionally have 3-cornered, 4-cornered, rhomboid or polygonal shapes.

Many factors influence the operation of the plansifters. Thus, a newly covered sieve frame generally works better, since the wear on the covering as well as the degree of tension of the sieve screen are important. However, experience shows that the capacity of a plansifter, even in the best condition, is subject to natural limits. The intensity of the oscillating movement, that is, the maximum acceleration, is also limited by the maximum allowable forces in the plansifter housing on the one hand and by the movement behavior of the product on the other hand. Excessive acceleration forces prevent the product from flowing through freely. Accordingly, the output data are determined depending on the specific quality of the individual sifting fractions.

It is suggested in DE-AS No. 25 06 981 to provide the base plate with a saw-toothed surface so that the product removal proceeds as quickly as possible due to corresponding impact forces. In very specific cases, it is entirely conceivable that this will bring about advantages. But, as far as is known, such a solution has not been introduced commercially to any extent. It would be expected that particularly difficult, fine grinding fractions would clog the base plates or sieve boxes very quickly. In a mill the plansifter is the machine requiring the greatest expenditure on cleaning. More recently it has become increasingly important for the processing machinery to be self-cleaning when possible and, when not, easy and inexpensive to clean.

OBJECT AND SUMMARY OF THE INVENTION

A primary object of the present invention was to provide increased output with a given sieve box volume, but also, in which in particular handling is improved and the complex of problems related to cleaning is largely alleviated.

The solution according to the invention is characterized in that the sieve frame is provided with a covering on only one side and preferably has partitioning strips in at least in one direction for forming a corresponding number of cleaning zones for sieve and base plates, wherein the cleaning member or members can be inserted into the cleaning zone or zones so as to be supported on the base plate.

In a mill, as is well known, the numerous sieve coverings must be changed as determined by technical diagrams and defective sieves must be replaced. For this purpose, a correspondingly large number of reserve sieve frames are kept ready for use outside the plansifter so that they can be exchanged quickly.

The former conventional view in technical circles was that a goal-oriented optimization of sieve screen cleaning and base clearing independently would achieve optimum results. However, the invention has now proved exactly the opposite. By consolidating the space occupied by the previous sieve screen cleaners and that occupied by the base cleaners, the resulting cleaning zone, as a free fall-through and product removal space, can be made greater than each of the two zones individually, but smaller than both of them taken together. In this way the efficiency of both functions is increased which, together with an advantageous construction of combined cleaning members, is one of the essential factors for the surprisingly positive sifting effect and for the increase in the sifting capacity while maintaining the same sifting quality. But at the same time a number of problems are solved very advantageously in a completely surprising manner. These are in particular:

a quick change of sieve frames, a quick change of sieve cleaners, easy cleaning of the entire plansifter sieve, increased capacity of the plansifter, reduction in overall height, etc.

The invention allows a number of particularly advantageous constructions. When partitions are used, the sieve box and sieve frame preferably have matching strip partitions for the purpose of a two-sided fine-product discharge. The sieve frame can be provided, in addition, with transverse partitions for forming a plurality of cleaning zones and a corresponding number of cleaning members. For example, 2 to 9 or preferably 6 to 12 cleaning zones are formed which preferably have an approximately square shape. It is further suggested to design the sieve frames as optionally exchangeable insert sieve frames having the smallest possible vertical dimensions. In a particularly preferred manner, the insert sieve frames are constructed as metal frames, especially as aluminum or light-alloy frames. The novel insert sieve frame should have a sufficient inherent rigidity. The forces occurring due to the fact that sieve coverings are provided on only one side should not cause deformations of the insert sieve frame, even when the latter is not screwed together with the sieve box. But at the same time this achieves several advantages. For the first time, the insert sieve frame can now be cleaned with ease, since it can be easily removed from the sieve box and particularly because the sieve screen can now be cleaned on both sides at low cost, e.g. by means of brushes or compressed air. When the insert frame is produced from metal, this part can also be treated completely separately with water, hot steam, etc., which was previously difficult due to the wooden construction.

It is very advantageous for handling if the sieve frame with the sieve screen is flush with the top of the sieve box. This results in an even tension in the stack and in stable stacks.

However, it is also possible to construct the insert sieve frame as a metal-wood composite, although this is disadvantageous in terms of cost. The sieve frames and sieve boxes are preferably adapted to one another in such a way that the sieve frame can be inserted or placed loosely in or on the sieve box. However, a quick-clamping connection also has certain advantages.

The sieve frame is advantageously a welded assembly of light-alloy sections. The sieve box is constructed in a manner known per se as a wooden frame which is stable with respect to shape and dimensions and has 1 to 3 lateral channels. The surfaces coming into contact with the product are preferably coated with plastic. On the other hand, the base plate of the sieve frame can be produced from metal, i.e. sheet metal. In special cases the base plate can also be produced from plastic.

Further, a particularly preferred essential point of the invention resides in the cleaning member itself which can be inserted into the clearing zones so as to be supported on the base plate. The cleaning member is provided with a wobble foot which is preferably produced from non-metallic material and arranged in the region of the vertical gravitational axis of the cleaning member so that the corresponding wobbling movements cause a constantly alternating sieve screen cleaning and base clearing. A number of particularly effective shapes have also been discovered.

According to a first construction, the cleaning member is constructed as a boomerang with two projecting arms having cleaning means protruding from the top for the sieve screen and a base- and slot-clearing projection is preferably arranged at the cleaning member so as to face in the opposite direction of the projecting arms.

According to a second construction, the cleaning member is constructed with three arms, at least two of the arms having cleaning means at the top for the sieve screen and one arm having an outwardly elongated base- and slot-clearing projection.

According to a fourth construction, it is constructed with four arms, at least one arm having an elongated base- and slot-clearing projection.

However, it is very important that all of the constructions be produced from springing-elastic material, preferably plastic without metal. The sieve cleaner is accordingly thrown in one direction or the other due to the corresponding spring force whenever an arm impacts at the sides of the sieve box or at the strips. Due to corresponding uninterrupted movements, including the wobbling movement, each part, whether the base plate or the sieve screen, is cleaned at high speed considered statistically. Even the smallest quantities of fines are carried away. The sieve cleaner should be large enough so that it has a certain mass and its greatest horizontal dimension is more than 50% of the corresponding smallest dimension of the individual clearing zones. In addition, an optimal cleaning effect has been shown in all tested shapes when the formed clearing zones have as far as possible a square shape in outline, since the cleaners then clean optimally in all spatial directions and remove the product quickly.

Optimal operation was formerly achieved when the arms had a roof-like cross section with the tip on top and the broad part at bottom. This not only reinforces the movement of the product over the base plate but also helps the cleaning member itself to remain clean without adhering product. The tops of the arms preferably have different cleaning means, e.g. bristles or knobs and/or cleaning ribs. The base is cleaned in an optimal manner when a sliding foot is arranged at only one arm.

The sieve cleaner should be constructed so as to be somewhat lower than the clear height between the base and the sieve covering. In order for the base and sieve screen to receive equal treatment, the sieve cleaner is provided in its center region with a wobble foot so that the extreme ends of the arms process both planes in addition to the horizontal movement of the sieve cleaner along the base in a constant alternation of upward and downward tilting movements.

Another particularly advantageous construction consists in that the arms are provided with an impact head of plastic at their extreme ends. This impact head serves on the one hand to protect the screen cleaning means in the form of knobs or brushes and on the other hand enables the lowest possible construction of the sieve frame and reinforces the springing movement of the cleaning member so that the member is not damaged.

According to another particularly advantageous construction of the invention, the arrangement has a plurality of sieve stacks arranged in a plansifter housing, each of these sieve stacks being formed by a large number of sieve boxes with base plate, sieve frame and sieve channels and having a rectangular or square shape, and is characterized in that the sieve frames covered with sieve screen are exchangeable with respect to the sieve boxes, and the sieve boxes, together with the sieve frames, form free fall-through and product discharge spaces over the base plate in which the sieve cleaners can be inserted so as to be supported on the flat base plate, and the sieve frames are constructed without a supporting grating so as to reduce the acoustic pressure of source noise.

Since it was formerly impossible to reduce the noise of a large plansifter to a significant extent, it was surprising that a noise level only slightly higher than 72 dB(A) has resulted in a plansifter according to the invention, compared to 84 dB(A) in comparable plansifters of the prior art. An important step consists in the choice of the particular sieve cleaners which are preferably made from non-metallic material and in the choice of sieve frames lacking the previous metal supporting gratings for the sieve screen cleaners. There are no longer relative movements of metal against metal.

The invention is shown in more detail in the following with reference to a number of embodiment examples.

BRIEF DESCRIPTION OF THE DRAWINGS

Shown in the drawings are:

FIG. 9*a* a view according to arrow a;

PREFERRED EMBODIMENTS FOR CARRYING OUT THE INVENTION

FIGS. 1–4 are referred to in the following. A sieve box 1 has a plurality of discharge channels: two discharge channels 2A and 2A' for the sieve tailings or for coarse material and one discharge channel 2F for the sieve throughs or fines.

Figure 1:
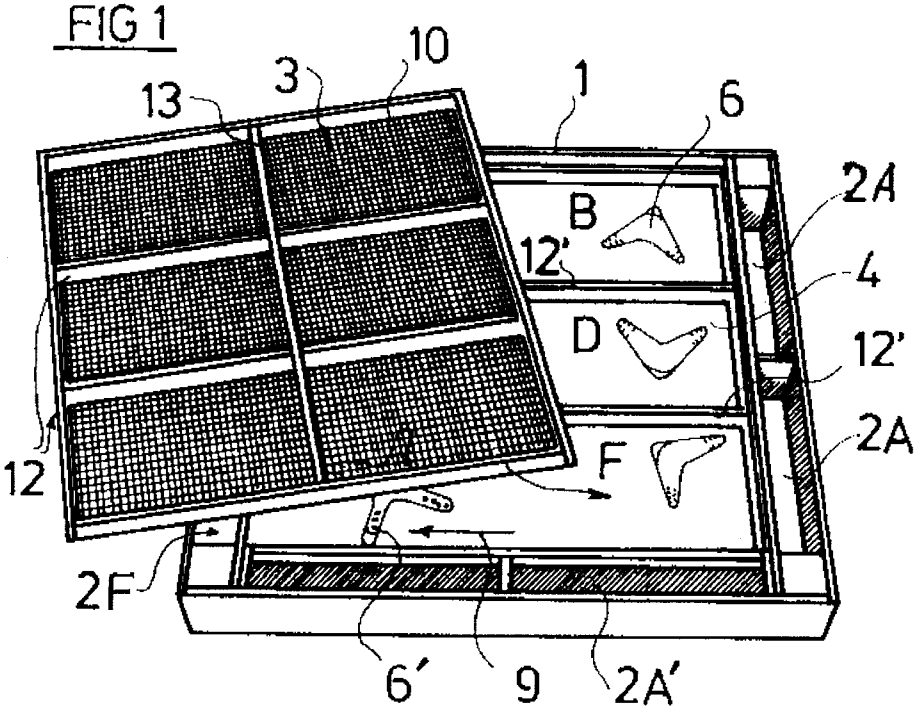
FIG. 1 a sieve frame being placed on a sieve box.

A sieve frame 3 is shown in FIG. 1 in a slightly inclined position representing a movement for placing the sieve frame 3 on the sieve box 1. The inner surface of the sieve box 1 below the sieve frame is closed by a flat base plate 4 so that the fine product or sieve throughs can only be removed through lateral slot openings 5 of the base plate 4 (FIG. 3). Sieve cleaners 6 and 6' respectively, are placed on the base plate 4 already before the sieve frame 3 is inserted The sieve cleaners 6 and 6' respectively, have a dual function. A clearing foot 7 serves to clear the sieve throughs from the flat base plate 4. According to the example in FIGS. 1–4, the fine product is discharged only via the discharge channel 2F so that the fine product must be moved in a corresponding longitudinal direction (arrow 9) along the entire length of the base toward the slot openings 5. The sieve box 1 has strips 12' directly over the base which divide the surface of the base plate 4 into three longitudinal zones. These strips 12' serve primarily to increase the stability of the base plate 4. The sieve frame 3 likewise has strips 12 which are arranged precisely above the strips 12 of the base plate. The sieve frames also have transverse strips 13. Accordingly, in the example shown in FIGS. 1 to 4, there are clearing zones B, D and F which result from the strips 12' of the base plate 4, as well as additional clearing zones A, C and E resulting from the further division of the sieve frame 3 by the transverse strips 13. The number of clearing zones (A . . . F) is accordingly determined by the corresponding partitioning of the insert sieve frame. It is of critical importance that a cleaning member 6 be inserted into each common clearing zone formed in this manner. In combination, these cleaning members 6 constantly free the sieve screen above and clear off the base below.

Figure 2:
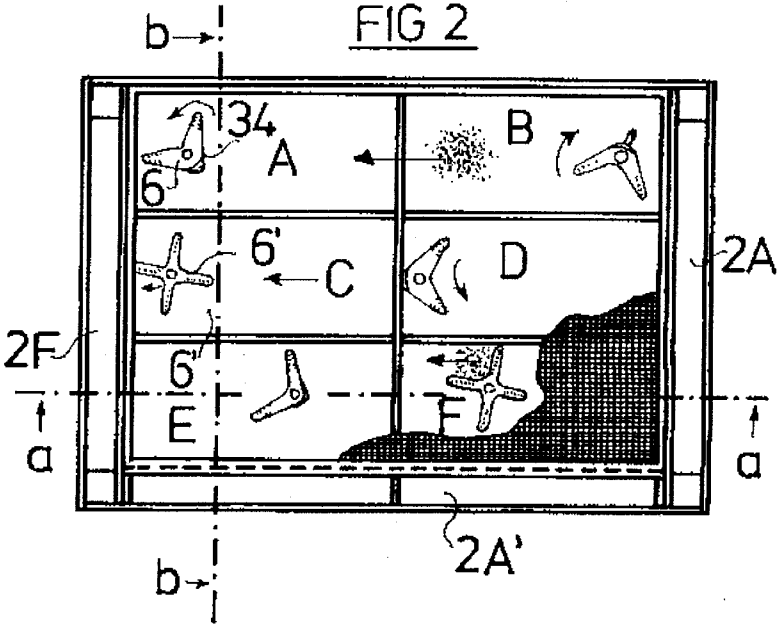
FIG. 2 an outline of a sieve box with inserted sieve frame, partially without sieve screen.
Figure 3:
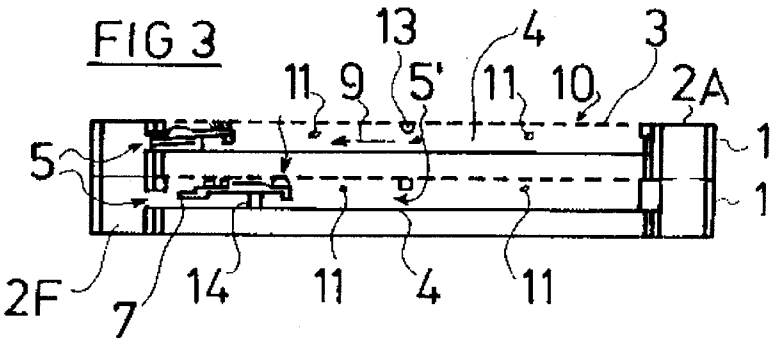
FIG. 3 a section a—a of FIG. 2.
Figure 4:
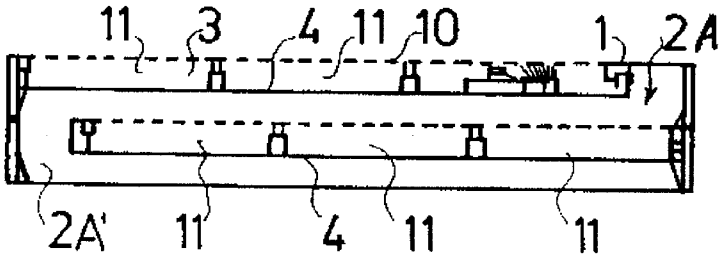
FIG. 4 a section b—b of FIG. 2.

FIGS. 3 and 4 show a section of FIG. 2 in which two sieve boxes 1 are placed one on top of the other. A sieve frame 3 is inserted into each sieve box 1 so that a free product fall-through and discharge space 11 in which the sieve cleaners 6, 6', etc. can move freely is formed between the sieve screen 10 and the base plate 4. The clearing foot 7 of the cleaning members 6, 6' has the additional function of conveying the fine product from cleaning zone B to cleaning zone A or from D to C or from F to E, which does not present difficulty since the transverse strips 13 are arranged only at the sieve frames 3 and not at the base plate resulting in a slot 5' at the corresponding location over the base plate. Thus, the sieve screen 10 is constantly cleaned along the entire surface of the sieve by upwardly projecting knobs or bristles. The sieve cleaner has a wobble foot 14 in its central region so that the sieve cleaner alternately carries out the corresponding function due to slight tilting movements first at the top and then on the bottom and, excluding frictional and inertial forces, can move freely along the flat base plate 4.

A multiple-arm construction of the cleaning members 6, 6' has the great advantage that each surface portion of the sieve screen, including the outermost corners, is constantly kept clean exactly as in the base plate. The cleaning members provide for an optimal cleaning action in all spatial directions. The relatively large mass of the sieve cleaner as well as the low-friction base plate reinforce a very intensive movement of the sieve cleaners 6, 6'. The cleaner can also keep particularly the sieve screen and base plate clean over longer periods of operation.

Figure 6:
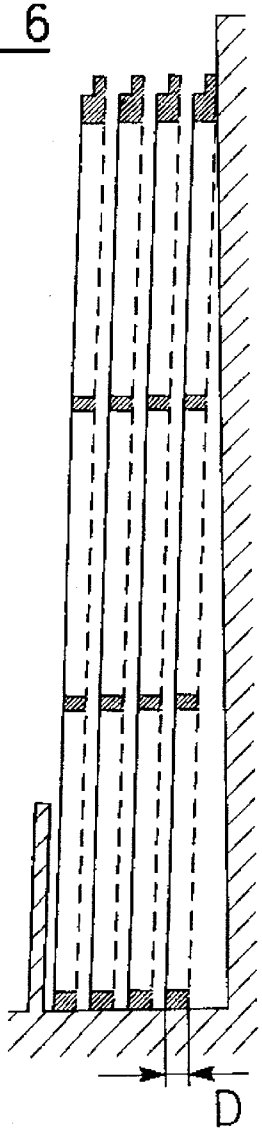
FIG. 6 a section c—c of FIG. 5, wherein a plurality of insert sieve frames are stacked.
Figure 5:
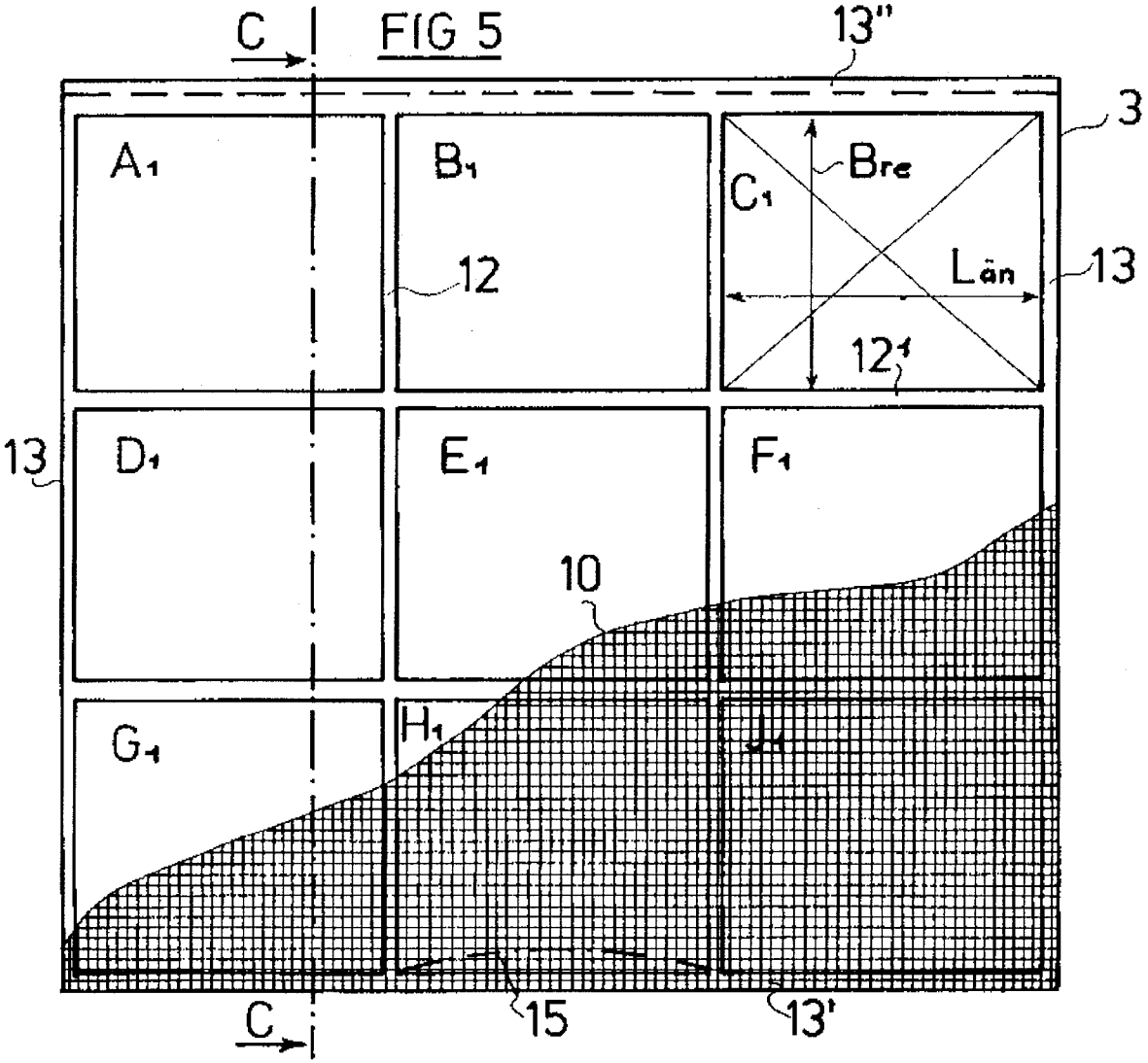
FIG. 5 an individual insert sieve frame.

FIG. 5 shows a virtually ideal square clearing or cleaning zone division with 9 zones. The sieve screen 10 is shown only over half of the sieve frame 3. The length of a cleaning zone is designated by Län and the width is designated by Bre. Considerable forces are applied for the sieve covering. Another essential point of the new invention consists in that the sieve frames are produced from thin, light metal strips which is particularly significant for the frame sections 13, 13' and 13". As can also be seen from FIG. 6, the sieve frames 3 have a covering, namely the sieve screen covering, on only one side. The sieve frame is open on the opposite side so that the sieve screen 10 is for the first time equally accessible and easily cleaned on both sides due to the insert- or exchangeable frames. The entire light-metal frame can be produced in one piece by diecasting, but is preferably a welded construction. It is very important that the frame allow very minimal bending in the elastic region due to the tensile forces from the sieve covering. This helps to maintain the tension in the sieve screen during operation. The bending is indicated symbolically by line 15 (FIG. 5). A large number of reserve sieve frames 3 with different coverings must be reserved for changing sieves. Since the sieve frames have sufficient inherent stiffness with very thin frame sections and have only approximately half the thickness D of the known sieve frames, only a small amount of space is required for storing replacements as can be seen from FIG. 6. However, the strips 12, 12' are also advisably produced from a corresponding metal section which can be a solid or hollow section. The use of an all-metal frame has proven advisable. Such a frame has a high resistance to bending when a corresponding coefficient of elasticity is selected in a preferred manner. However, the sieve frame can also be constructed as a metal-wood or metal-plastic composite.

Figure 7:
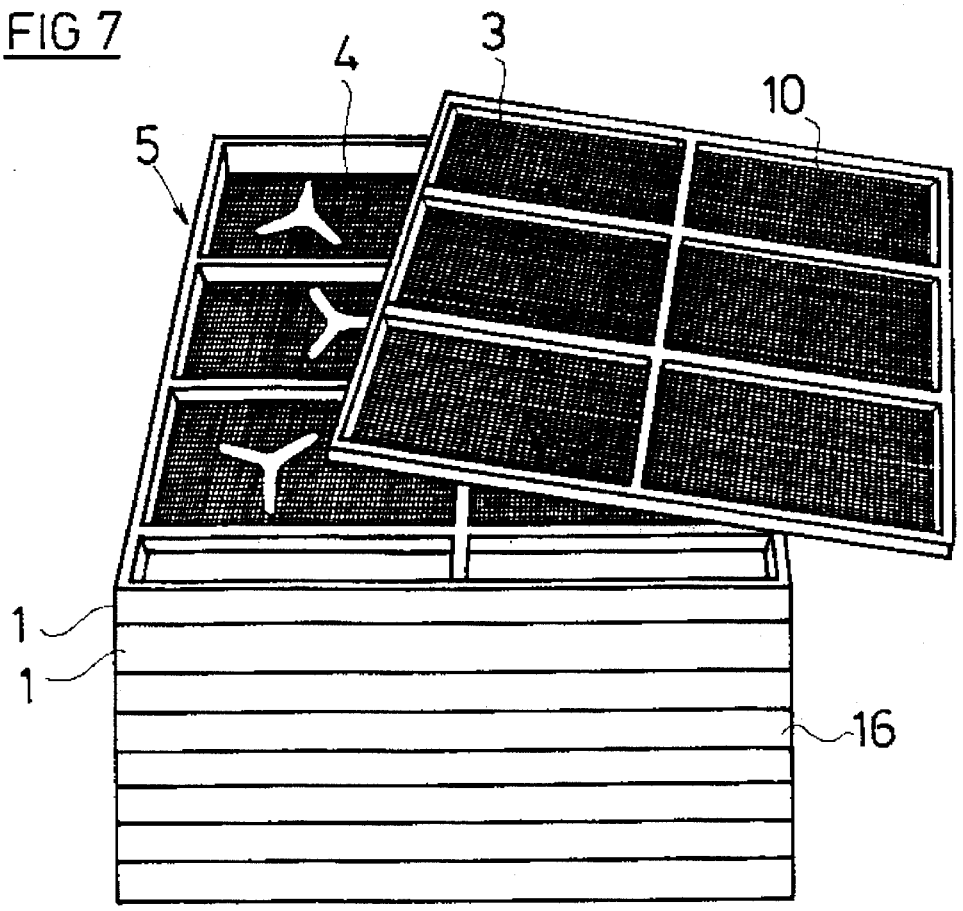
FIG. 7 a stack of sieve boxes with the uppermost insert sieve frame being placed on top.

FIG. 7 shows a stack 16 of eight sieve boxes 1 stacked one on top of the other in which three-armed sieve cleaners are inserted.

Figure 8:
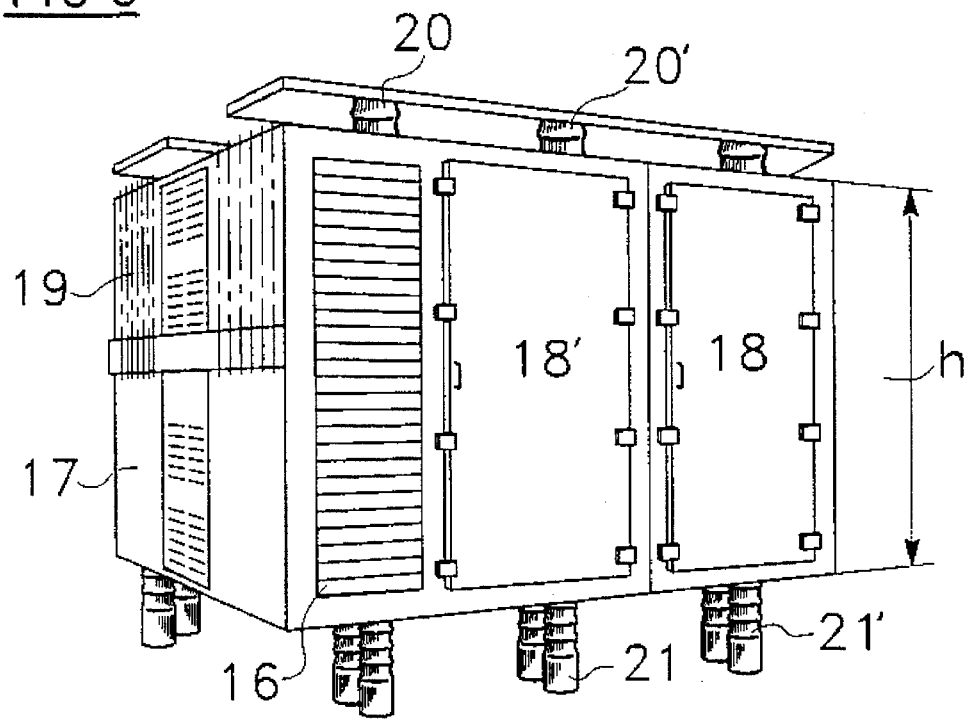
FIG. 8 a large plansifter with installed sieve stack.

FIG. 8 shows an entire square plansifter, where the door 18 is removed from one sieve compartment and an entire sieve stack 16 is visible. The sieve stack 16 has sieve boxes 1 in a known square plansifter 24. The number of sieve boxes and sieve frames can be increased by at least 10% with the sieve box according to the invention while retaining the spaces for the product transport over the sieve and the same height of the plansifter housing. The entire plansifter 17 has a centrifugal drive, not shown, which imparts a circular motion to all sieves. For this reason, the plansifter 17 is suspended on rods 19 as a free vibrator. The product is fed to the sieve stacks via feed sleeves 20, 20' etc. and the sorted product is guided off via discharge sleeves 21, 21' etc.

Figure 9C:
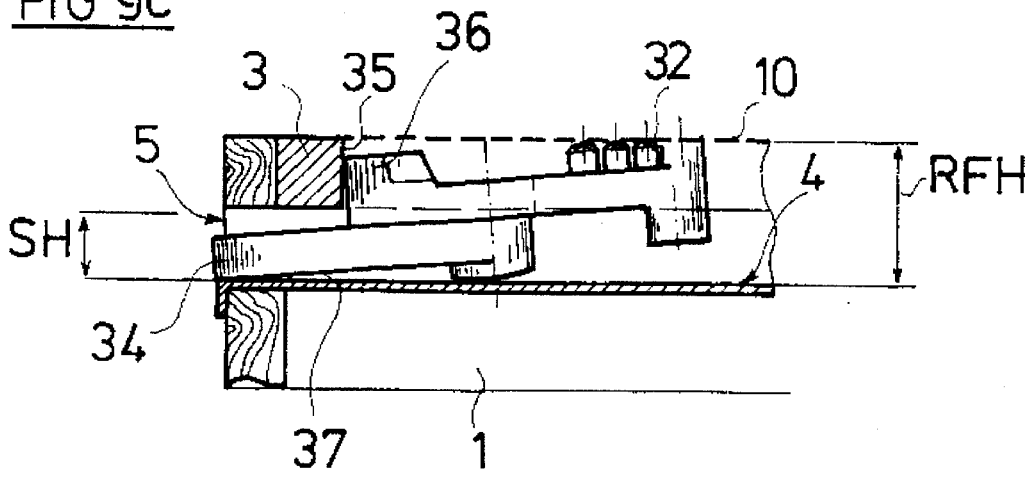
FIG. 9*c* the same sieve cleaner used for slot cleaning.
Figure 9A:
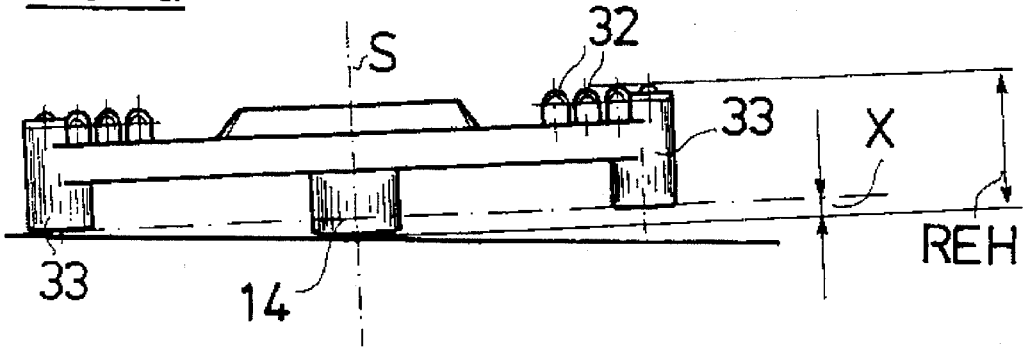
Figure 9:
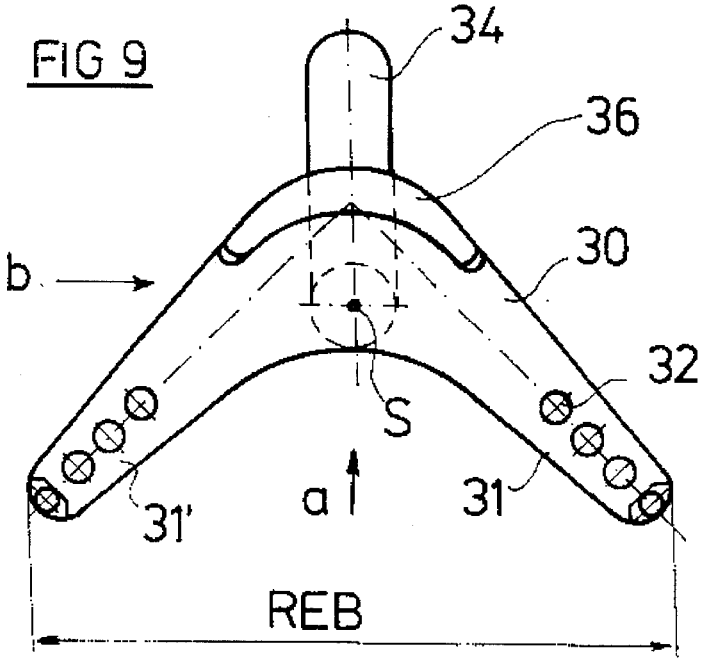
FIG. 9 a sieve cleaner with boomerang shape in outline.
Figure 9B:
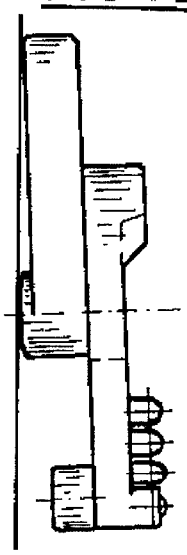
FIG. 9*b* a side view according to arrow b.

In FIGS. 9, 9*a* and 9*c*, a cleaning member is constructed as a boomerang 30 with two cleaning arms 31 and 31', respectively, facing away from one another at an angle in typical fashion. The two arms are provided at top with knobs 32 which have the function of cleaning the sieve screen. The boomerang 30 is provided with a wobble foot 14 in the vertical gravitational axis S. The wobble foot 14 projects out by a distance "X" of several millimeters relative to the two supporting feet 33 and 33'. Further, the boomerang 30 has a base- and slot-clearing projection 34 in the opposite direction of the two arms 31 and 31', respectively, which projects out far enough so that the corresponding part can push the fine product through the slot 5 as shown in FIG. 9*c*. The boomerang 30 has an impact elbow 36 in the direction of the base- and slot-clearing projection 34 so that the necessary impacts on the side portions 35, e.g. of the sieve frame 3, are also produced during slot cleaning. It is very advantageous for perfect functioning of the cleaning member if only the wobble foot 14 projects out, but the supporting feet 33, 33' and the lower base-clearing edge 37 of the slot- and base-clearing projection 34 are the same height. This produces a free interplay between the operative members and statistically there is a roughly equal number of work actions with very high accuracy in a corresponding manner. In FIG. 9*c*, the knobs 32 act to clean the sieve screen 1 and the base- and slot-clearing projection 34 acts to clean the slot 5 simultaneously.

Figure 10A:
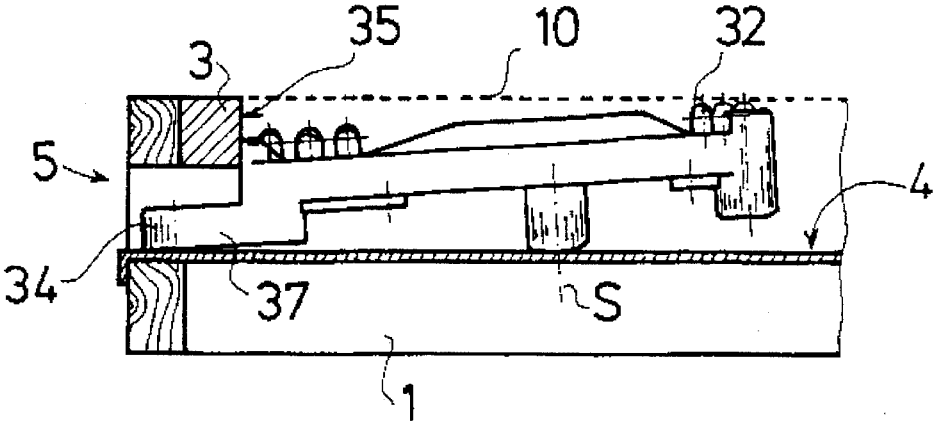
FIG. 10*a* the 3-armed sieve cleaner for slot cleaning.
Figure 10:
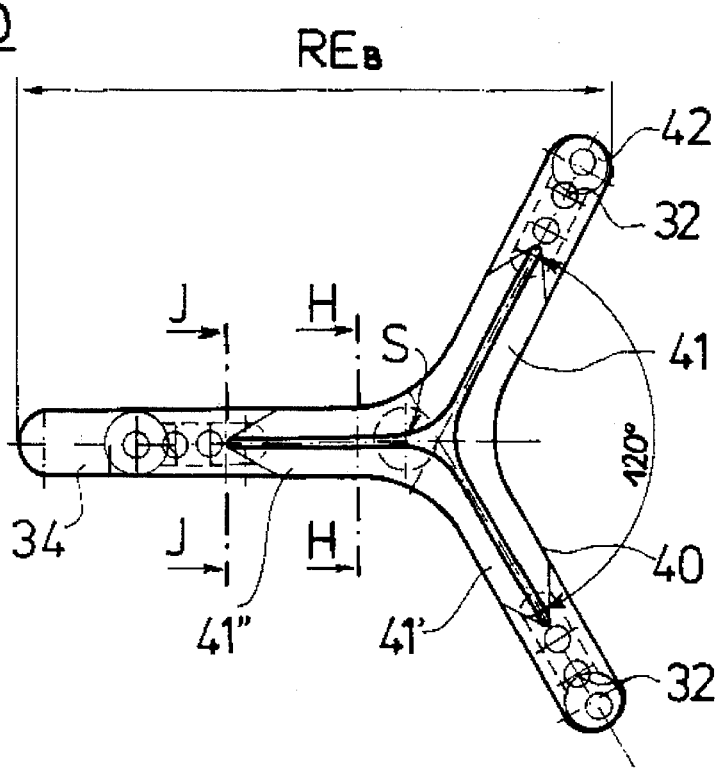
FIG. 10 a 3-armed sieve cleaner in outline.
Figure 10B:
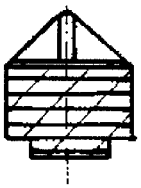
FIG. 10*b* a section J—J of FIG. 10.
Figure 10C:
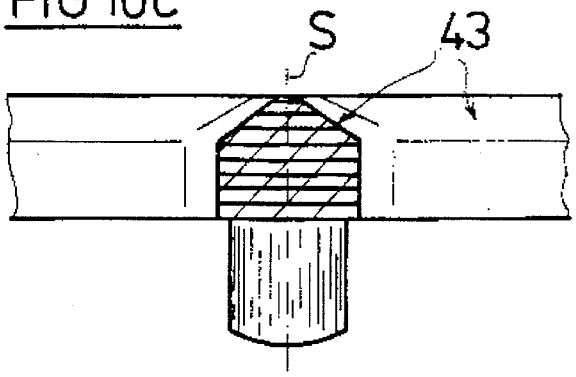
FIG. 10*c* a section H—H of FIG. 10.

FIG. 10 shows a three-sided star 40 in which three arms 41, 41' and 41" project away from one another so as to be offset by 120°. To protect the sieve screen cleaning means e.g. for the knobs 32, each of the arms is constructed outwardly as an impact head 42 forming the actual impact part for the sieve cleaner. As can be seen from the two sections H—H and J—J, the arms 41, 41', 41" have a roof-like shape in cross section. The two arms 41, 41' are identically constructed, whereas the arm 4" has a base- and slot-clearing projection 34 in addition.

Figure 11A:
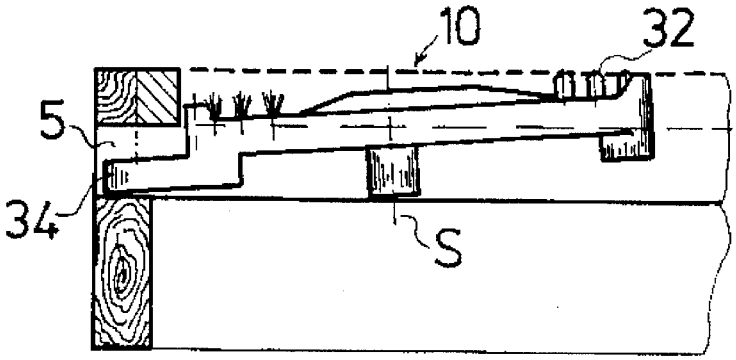
FIG. 11*a* in a cleaning position in the slot and at the sieve screen.
Figure 11B:
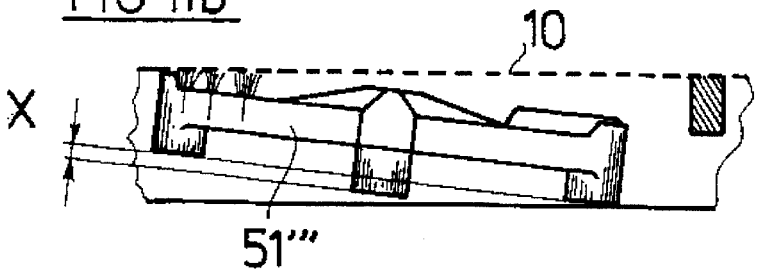
FIG. 11*b* in the sieve cleaning position.
Figure 11:
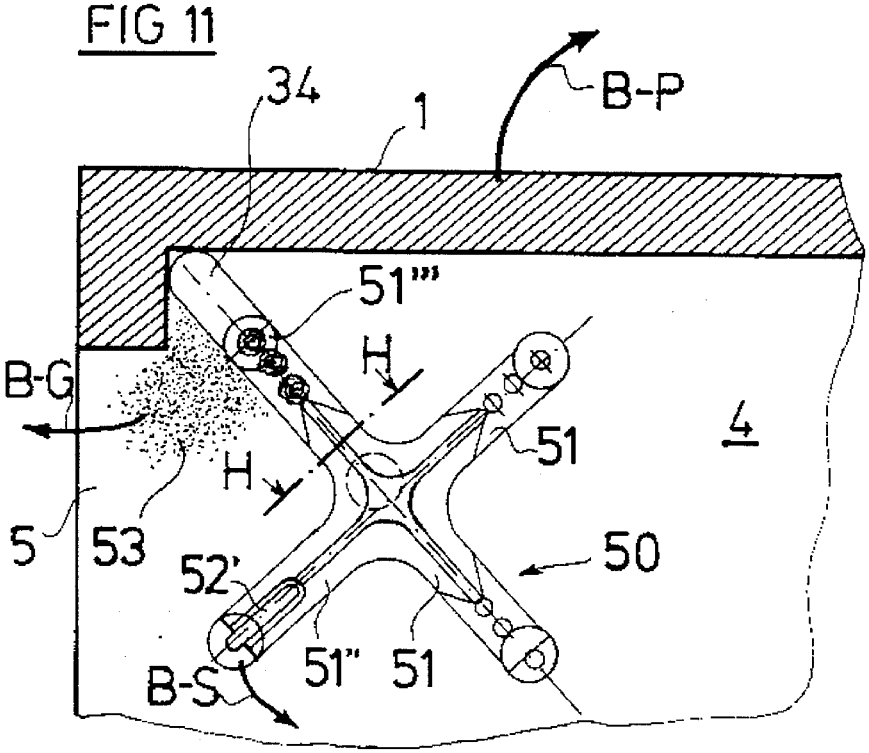
FIG. 11 a 4-armed sieve cleaner in outline in a corner cleaning position.

FIGS. 11–11*b* show a 4-sided star 50. The arms 51 and 51' are identically constructed. The arm 51" is similar, but has a cleaning rib 52 instead of a cleaning knob. The arm 51'" also has a base- and slot-clearing projection 34 analogous to the 3-sided star 40. In FIG. 11*a*, the knobs 32 are used for cleaning the sieve screen, whereas in FIG. 11*b* bristles are incorporated in the arm 51'" for cleaning the sieve screen 10. FIG. 11 shows a phase in which the 4-sided star cleaner 50 cleans a corner of the sieve box base 4. An accumulation of product 53 is pushed directly into the slot opening 5 according to arrow B-G as a result of the relative movement B-S between the 4-sided star cleaner 50 and the plansifter and base 4, respectively, according to arrow B-P. It is possible to construct cleaning members with more arms, but this would be no more advantageous with respect to the cleaning intensity.

While the foregoing description and drawings represent the preferred embodiments of the present invention, it will be obvious to those skilled in the art that various changes and modifications may be made therein without departing from the true spirit and scope of the present invention.

What is claimed is:

1. A plansifter sieve comprising:

a sieve box having a outer frame, a base plate, at least one box partitioning strip for dividing the sieve box into a plurality of cleaning zones, and a discharge opening corresponding to each cleaning zone;

a removable, exchangeable sieve frame covering the sieve box, the sieve frame having a sieve covering on only one side; and a plurality of freely movable cleaning members, wherein each cleaning zone has at least one freely movable cleaning member.

2. The plansifter sieve according to claim 1 wherein the removable sieve frame includes at least one frame partitioning strip, the frame partitioning strip aligned with and adjacent to the at least one box partitioning strip when the sieve frame is covering the sieve box.

3. The plansifter sieve according to claim 1 wherein the at least one box partitioning strip and at least one frame partitioning member are longitudinally arranged.

4. The plansifter sieve according to claim 3 wherein the removable frame also includes at least one frame partitioning member transverse to the at least one longitudinally arranged frame partitioning strip, thereby further dividing the sieve box into at least twice as many cleaning zones, the transverse frame partitioning member extending only partially into the sieve box to prevent the freely movable cleaning members from moving between adjacent cleaning zones.

5. The plansifter sieve according to claim 4 wherein the cleaning zones are approximately square in shape.

6. The plansifter sieve according to claim 1 further comprising at least two discharge channels, one discharge channel being adjacent the discharge openings.

7. The plansifter sieve according to claim 1 wherein the sieve box is constructed of wood, the surfaces coming into contact with product is coated with plastic, and the base plate is constructed of metal or plastic.

8. The plansifter sieve according to claim 1 wherein the sieve box has two discharge openings on opposite sides.

9. The plansifter sieve according to claim 1 wherein the top of sieve frame is even with the top of the sieve box.

10. The plansifter sieve according to claim 1 wherein the removable sieve frame is secured on the sieve box with quick-clamping means.

11. A removable, exchangeable sieve frame for covering a sieve box comprising:

a rigid rectangular metal frame having a top side;

at least one metal partitioning member connected to and extending between two opposing sides of the rigid rectangular metal frame; and a covering mounted on only one side of the rigid rectangular frame, the covering being a sieve covering and being mounted on only the top side of the rigid rectangular frame, whereby the frame possesses sufficient rigidity to resist deformation thereby allowing the metal frame, the partitioning member, and the sieve covering to be removable from the sieve box as a unit.

12. The removable sieve frame of claim 11 wherein the frame member and the partitioning member are constructed of aluminum or a light-alloy metal.

13. A cleaning member for a plansifter, wherein the plansifter includes a covering, a base plate and a discharge opening, the cleaning member comprising:

a boomerang-shaped body having a vertex and two ends and a vertical gravitational axis;

covering cleaning means disposed on the top of each of the two ends;

a projection disposed on an extension arm extending from the vertex and away from the two ends for clearing the base plate and discharge opening; and a wobble foot in the region of the vertical gravitational axis.

14. A cleaning member for a plansifter, wherein the plansifter includes a covering, a cleaning zone, a base plate and a discharge opening, the cleaning member comprising:

a main body with a plurality of extension arms and having a vertical gravitational axis;

covering cleaning means disposed on at least two of the plurality of arms;

an outwardly extending projection disposed on at least one of the plurality of arms for clearing the base plate and discharge opening; and a wobble foot in the region of the vertical gravitational axis.

15. The cleaning member of claim 14, wherein the main body has three extension arms.

16. The cleaning member of claim 14, wherein the main body has four extension arms and at least one extension arm has a covering cleaning means and an outwardly extending projection for clearing the base plate and discharge opening.

17. The cleaning member of claim 14 wherein each extension arm has a roof-like cross-sectional shape.

18. The cleaning member of claim 14 wherein each extension arm has cleaning means attached to the extreme ends of the extension arms, and wherein the extension arms have different cleaning means at the top in the form of bristles or knobs and/or cleaning ribs.

19. The cleaning member according to claim 14 wherein its greatest horizontal dimension is more than 50% of the smallest dimension of the individual cleaning zones.

20. A plansifter for sifting ground grain products comprising:

a plansifter housing;

centrifugal drive means for imparting a circular motion to the housing;

support means for supporting the housing;

stack means for feeding the ground grain products to the top of the plansifter;

discharge sleeve means for removing the sifted ground grain products from the bottom of the plansifter; and a plurality of plansifter sieves located in the housing and arranged one above another, each plansifter sieve comprising:

a sieve box having a outer frame, a base plate, at east one box partitioning strip for dividing the sieve box into a plurality of cleaning zones, and a discharge slot opening corresponding to each cleaning zone;

a removable, exchangeable sieve frame covering the sieve box, the sieve frame having a sieve covering on only one side; and a plurality of freely movable cleaning members, wherein each clearing zone has at least one freely movable cleaning member.

21. A removable, exchangeable sieve frame for covering a sieve box comprising:

a rigid rectangular metal frame having a top side and a bottom side;

at least one metal partitioning member connected to and extending between two opposing sides of the rigid rectangular metal frame; and a sieve covering mounted on only the top side of the rigid rectangular frame, whereby the bottom side is open and the frame possesses sufficient rigidity to resist deformation thereby allowing the metal frame, the partitioning member, and the sieve covering to be removable from the sieve box as a unit.

* * * * *

UNITED STATES PATENT AND TRADEMARK OFFICE

CERTIFICATE OF CORRECTION

PATENT NO. : 5,538,139

DATED : July 23, 1996

INVENTOR(S) : Alois Keller

It is certified that error appears in the above-indentified patent and that said Letters Patent is hereby corrected as shown below:

On the title page, item [57] Abstract line 3, "east" should read --designed--

Claim 20, column 10, line 27, "east" should read --least--.

Signed and Sealed this

First Day of October, 1996

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,538,139
DATED : July 23, 1996
INVENTOR(S) : Alois Keller

It is certified that error appears in the above-indentified patent and that said Letters Patent is hereby corrected as shown below:

On the title page, item [57] Abstract line 3, "design" should read --designed--.

Claim 20, column 10, line 27, "east" should read --least--.

This certificate supersedes Certificate of Correction issued October 1, 1996.

Signed and Sealed this
Twenty-first Day of January, 1997

*Attest:*

*Attesting Officer*

BRUCE LEHMAN

*Commissioner of Patents and Trademarks*